US008297956B2

(12) United States Patent
Neftel et al.

(10) Patent No.: US 8,297,956 B2
(45) Date of Patent: Oct. 30, 2012

(54) PERISTALTIC PUMPING SYSTEM

(75) Inventors: Frédéric Neftel, Lausanne (CH); Florent Junod, Lausanne (CH)

(73) Assignee: Debiotech S.A., Lausanne (CH)

( * ) Notice: Subject to any disclaimer, the term of this patent is extended or adjusted under 35 U.S.C. 154(b) by 932 days.

(21) Appl. No.: 11/587,438

(22) PCT Filed: Apr. 27, 2005

(86) PCT No.: PCT/IB2005/051372
§ 371 (c)(1),
(2), (4) Date: Oct. 25, 2006

(87) PCT Pub. No.: WO2005/106251
PCT Pub. Date: Nov. 10, 2005

(65) Prior Publication Data

US 2008/0014105 A1 Jan. 17, 2008

(30) Foreign Application Priority Data

Apr. 30, 2004 (EP) ..... 04405275

(51) Int. Cl.
*F04B 43/12* (2006.01)

(52) U.S. Cl. ..... 417/477.8; 417/477.3; 417/474

(58) Field of Classification Search ..... 417/475, 417/476, 477, 474, 477.1–477.9, 477.11, 417/477.12
See application file for complete search history.

(56) References Cited

U.S. PATENT DOCUMENTS

| | | | | |
|---|---|---|---|---|
| 3,447,478 | A * | 6/1969 | Clemens | 417/477.8 |
| 4,573,887 | A | 3/1986 | Smith | |
| 4,909,713 | A | 3/1990 | Finsterwald et al. | |
| 5,044,902 | A | 9/1991 | Malbec | |
| 5,586,872 | A * | 12/1996 | Skobelev et al. | 417/477.8 |
| 5,927,956 | A | 7/1999 | Lim et al. | |
| 2005/0238515 | A1 * | 10/2005 | Kent | 417/476 |

FOREIGN PATENT DOCUMENTS

JP 7-122434 12/1995

OTHER PUBLICATIONS

International Search Report mailed Aug. 1, 2005 in PCT/IB2005/051372.
Written Opinion mailed Aug. 1, 2005 in PCT/IB2005/051372.
Japanese Office Action dated Nov. 2010, and English translation.

* cited by examiner

*Primary Examiner* — Charles Freay
*Assistant Examiner* — Alexander Comley
(74) *Attorney, Agent, or Firm* — Nixon & Vanderhye P.C.

(57) ABSTRACT

A peristaltic pumping system comprises a flexible tube, a substantially cylindrical rotating roller unit containing a series of rollers which are freely rotating around their axes and freely moving along a radial segment, holding mechanism for commonly holding the rollers, a central spreader element for pushing the rollers against the flexible tube and a driving unit comprising a driving coupling element, and the holding mechanism is made of at least one planar element having retaining and guiding means for rollers, and the planar element is furthermore adapted to be directly coupled to the coupling element in such a way that rollers are driven through the planar element.

9 Claims, 2 Drawing Sheets

PERISTALTIC PUMPING SYSTEM

This application is the US national phase of international application PCT/IB2005/051372 filed 27 Apr. 2005 which designated the U.S. and claims benefit of EP 04405275.1, dated 30 Apr. 2004, the entire content of which is hereby incorporated by reference.

The invention relates to peristaltic pumping systems comprising a flexible tube, a series of rollers adapted to compress the flexible tube in a peristaltic way, a driving unit and a housing which comprises a preferable cylindrical raceway for receiving the flexible tube.

A peristaltic pump unit of this kind is disclosed for instance in U.S. Pat. No. 5,044,902. This unit discloses the use of a central shaft which is in direct contact with the rollers. The shaft has two functions, namely, driving the rollers during use and pushing them against the flexible tube when the shaft is inserted into the system. This unit shows however some disadvantages. For instance, it wears rapidly and frequently blocks due to the opposite rotation direction of adjacent rollers.

One object of the invention is to provide a peristaltic pumping system of the type defined above, which is of a simple and robust construction and which allows an efficient pumping over prolonged period of time.

The peristaltic pumping system according to the invention comprises a flexible tube, a substantially cylindrical rotating roller unit containing a series of rollers which are freely rotating around their axes and freely moving along a radial segment, holding means for commonly holding the rollers, a central spreader element for pushing the rollers against the flexible tube and a driving unit comprising a driving coupling element, characterized by the fact that said holding means is made of at least one planar element having retaining and guiding means along such radial segment for rollers, said planar element being furthermore adapted to be directly coupled to said coupling element in such a way that rollers are driven through said planar element.

When the roller unit and the housing are separated from the driving unit, the rollers are brought back to the center under the pressure of the tube at rest, this tube remaining open, which makes possible an easy and complete sterilization.

The housing has preferably an internal groove with a concave cross-section into which is housed the flexible tube, while the rollers are externally barrel-shaped, with a convex curvature combined with the concave curvature of the groove of the housing, to rest against the flexible tube; such a housing with a concave internal profile allows a self-centering of the tube and the rollers.

The tubular rollers are generally made of a flexible plastic material. Their shape is not limited to shape indicated previously. They may be cylindrical or conical. They may also be of a flexible material to improve the elastic functioning of the peristaltic pumping system.

The driving unit preferably comprises a driving shaft provided with a support containing pins which are adapted to cooperate with holes in the planar element of the roller unit.

Preferably the spreader is loosely mounted on an extension of the driving shaft to avoid any friction with the rollers during use.

The invention consists, besides the arrangements explained above, in a number of other arrangements which will be more explicitly explained below with respect to the particular embodiments described with reference to the attached drawings, but which are in no way restrictive.

FIG. 1 of these drawings is a perspective view of a roller unit according to the invention.

Figure 3:
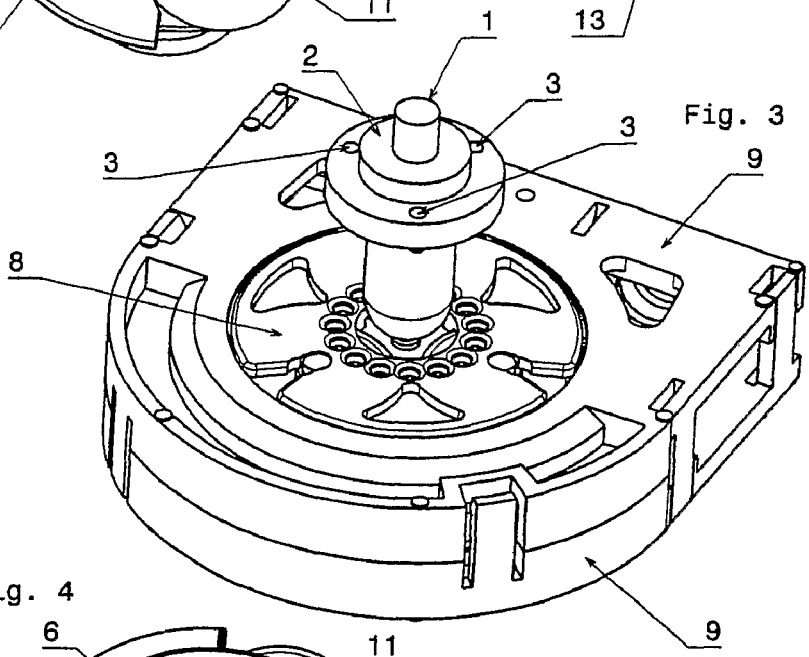
FIG. 3 shows a peristaltic pump unit according to the invention including the roller unit, the housing, the driving shaft and the spreader.

With reference to the drawings, a peristaltic pump system can be seen on FIG. 3, comprising a housing 9 containing a raceway 10 for receiving a flexible tube (not shown), forming the body of the pump. The tube is interposed between the housing walls and a roller unit 8,11 capable of co-operating with a support 2 fixed to a driving shaft 1 which is, in turn, driven by an electric motor (not shown).

Figure 5:
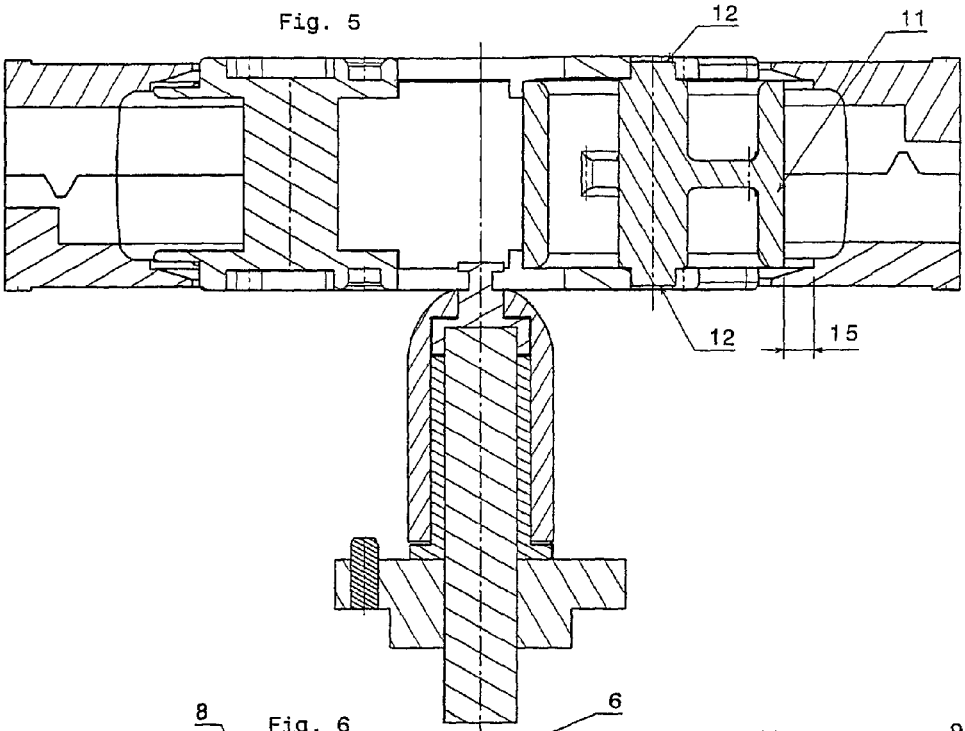
FIG. 5 is a longitudinal cross-section of the roller unit with the spreader-shaft arrangement in a non-active position.

FIGS. 3 and 5 represents a non-active position where the driving shaft 1 has not penetrated the roller unit 8,11.

The roller unit 8,11 is made of three rollers 11 held between two separator discs 8, the rollers 11 are commonly retained and guided through their axis ends 12 to the separator discs 8. At least one separator disc 8 contains a plurality of receiving means 13 which are adapted to receive the pins 3 of the driving support 2.

The driving shaft distal end extends from the driving support 2 and is covered by a sheath 5 freely rotating around the driving shaft 1. The sheath 5 is sufficiently large in order to act as a spreader which pushes the rollers 11 against the flexible tube when the shaft distal end penetrates the roller unit 8,11 (see FIGS. 4 and 6).

Figure 1:
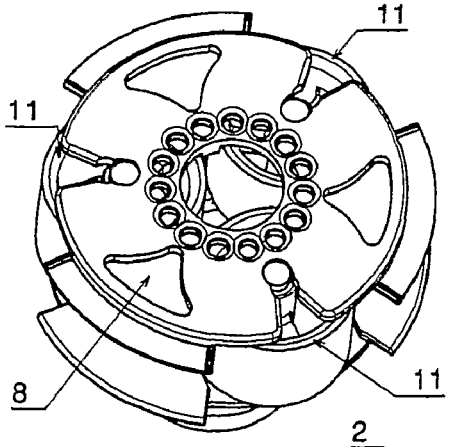
Figure 2:
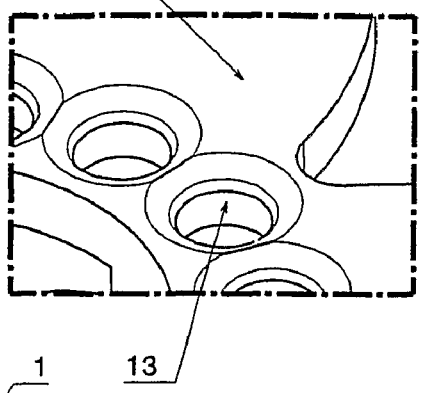
FIG. 2 is an enlarged view of a portion of the roller unit of FIG. 1.

When the housing 9 and the roller unit 8,11 are stored separately from the driving unit 1,2, the rollers 11 are brought back to the center under the pressure of the tube at rest, as can be seen in FIG. 1, this tube remaining open until stabilization of the rollers in a perpendicular position of reciprocal support. This allows to avoid a plastic deformation of the walls of the tube during storage, which could occur if the tube were stored in compressed condition and thereby induce a change in peristaltic performance during use (in particular with regard to flow rate and accuracy).

The tube can be kept in position by two welded stop rings foreseen for being clamped into accurate recesses under the pressure of a supporting collar integral with the cover of the cartridge.

When manufactured in series, this tube is mounted very quickly into the cartridge.

Figure 4:
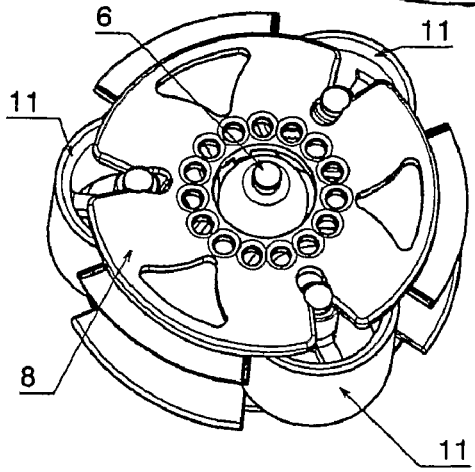
FIG. 4 represents the roller unit of FIG. 1 containing the spreader.
Figure 7:
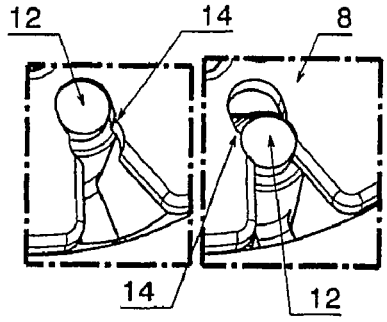
FIG. 7 is en enlarged view of a disc portion.
Figure 6:
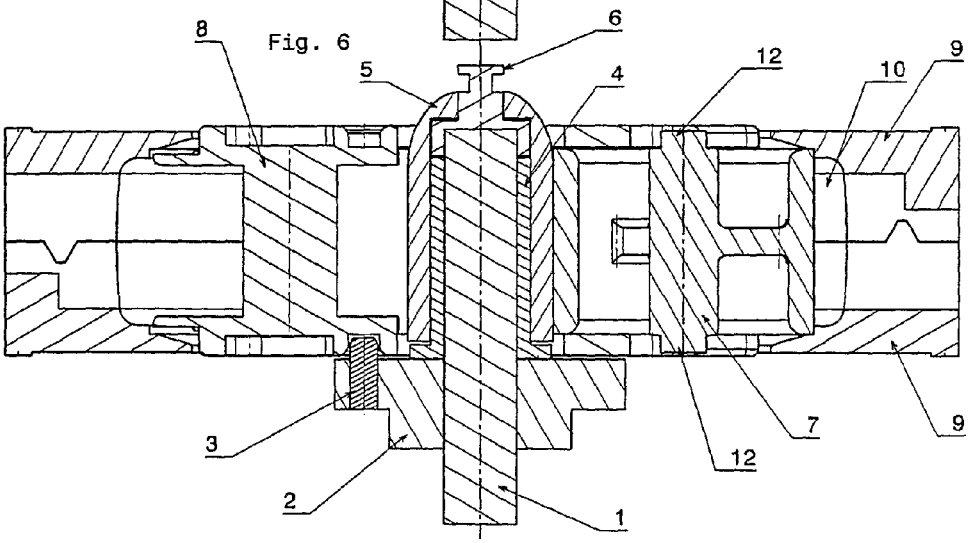
FIG. 6 is a longitudinal cross-section of the roller unit with the spreader-shaft arrangement in an active position.

The peristaltic pump unit operates as follows:

The housing 9 and the roller unit 8,11 are first placed on the driving unit 1,2 (see FIGS. 4 and 6). By this movement, the central shaft distal end, together with the sheath 5, pushes the rollers 11 against the tube and, in addition, the pins 3 engage the receiving means 13 of the discs 8. The coupling of said pin 3 in the receiving means can be self-aligned by having receiving means which are close to each other with a taper at the periphery to guide the pin into said receiving, said pin having a conical end.

Alternatively, the coupling can also be obtained by pins being placed on the disc 8 and the receiving means being placed on the driving unit 2.

The pumping action is obtained when the motor is started to rotate, driving the discs 8 and the rollers 11.

Alternatively, the driving of the disc 8 can also be obtained by a gear coupling on the periphery of such planar disc.

When the roller unit 8,11 and the housing 9 are separated from the driving unit 1,2 the rollers 11 are brought back to the centre under the pressure of the tube at rest, this tube remaining open.

In an alternative embodiment (not shown) the rollers are not able to return to the center position once they have been pushed by the central shaft and sheath 5 against the flexible tube. In such a case, once the central shaft has been removed the peristaltic system remains occlusive, such as to prevent free-flow after use. This can, for example, be obtained by having a cliquing position 14 on the separator discs at the position of the roller axis ends on the radial segment 15 of the separator discs so that the roller axis end has to pass such click 14 when the central shaft is inserted, but cannot return afterwards when the central shaft is removed.

Alternatively, this can also be obtained by having the sheath 5 remaining inside the roller unit 8,9 after the shaft is removed.

The invention claimed is:

1. Peristaltic pumping system comprising: a flexible tube, a substantially cylindrical rotating roller unit containing a series of rollers, each roller having a roller shaft, and the rollers are freely rotating around their roller shafts and are freely moving along a separate radial groove extending radially outward for each roller shaft, a planar element for commonly holding all of the rollers, and the planar element contains the separate radial groove for each roller shaft, a rod-shaped central spreader element which extends along a central axis of the roller unit for pushing the rollers against the flexible tube, and a driving unit comprising a driving coupling element, wherein each of said rollers is made of a single monolithic part comprising the roller shaft having two roller shaft ends, and a lateral wall, wherein the planar element has a retaining and guiding means for said roller shaft ends, said planar element being further adapted to be directly coupled to said coupling element in such a way that the rollers are driven through their roller shaft ends and through said planar element.

2. Peristaltic pumping system according to claim 1 comprising two parallel planar elements, the rollers being situated between said two parallel planar elements.

3. Peristaltic pumping system according to claim 1 wherein said spreader element is freely mounted on a distal end of a driving shaft.

4. Peristaltic pumping system according to claim 1 wherein said driving coupling element is directly fixed around a base of the central spreader element to be coupled underneath the planar element.

5. Peristaltic pumping system according to claim 4, wherein the driving coupling element comprises centering means adapted to allow a self centering of the driving coupling element.

6. Peristaltic pumping system according to claim 1 wherein said planar element contains a series of holes situated along a circle which is coaxial with respect to a rotating axis of the roller unit and wherein said driving unit contains at least one pin adapted to be received in one of said holes, the pin-hole combination allowing the fixation of the planar element to the driving unit.

7. Peristaltic pumping system according to claim 6 wherein said holes are adjacent along the circle, allowing thereby always a fixation of the planar element to the driving unit when both elements are approached.

8. Peristaltic pumping system according to claim 1 wherein said driving coupling element is directly fixed around a periphery of the planar element.

9. Peristaltic pumping system according to claim 1 comprising clicking means adapted to maintain the rollers against the flexible tube when the driving shaft is withdrawn.

* * * * *